US011105335B2

(12) United States Patent
Ragg et al.

(10) Patent No.: US 11,105,335 B2
(45) Date of Patent: Aug. 31, 2021

(54) RADIAL FAN

(71) Applicant: ebm-papst St. Georgen GmbH & Co. KG, St. Georgen (DE)

(72) Inventors: Peter Ragg, Schönwald (DE); Christian Moosmann, Königsfeld (DE)

(73) Assignee: ebm-papst St. Georgen GmbH & Co. KG, St. Georgen (DE)

( * ) Notice: Subject to any disclaimer, the term of this patent is extended or adjusted under 35 U.S.C. 154(b) by 154 days.

(21) Appl. No.: 16/489,366

(22) PCT Filed: Mar. 28, 2018

(86) PCT No.: PCT/EP2018/057944
§ 371 (c)(1),
(2) Date: Aug. 28, 2019

(87) PCT Pub. No.: WO2018/184946
PCT Pub. Date: Oct. 11, 2018

(65) Prior Publication Data

US 2019/0376525 A1 Dec. 12, 2019

(30) Foreign Application Priority Data

Apr. 7, 2017 (DE) ..... 10 2017 003 431.1

(51) Int. Cl.
*F04D 29/28* (2006.01)
*F04D 29/42* (2006.01)
*F04D 29/30* (2006.01)

(52) U.S. Cl.
CPC ..... *F04D 29/281* (2013.01); *F04D 29/4226* (2013.01); *F04D 29/30* (2013.01); *F04D 29/4213* (2013.01); *F05D 2250/712* (2013.01)

(58) Field of Classification Search
CPC ..... F04D 29/281; F04D 29/282; F04D 29/30; F04D 29/4213; F04D 29/4226;
(Continued)

(56) References Cited

U.S. PATENT DOCUMENTS

2005/0036887 A1* 2/2005 Nadjafizadeh ..... F04D 29/30 415/184
2013/0236303 A1* 9/2013 Teramoto ..... F04D 17/08 415/206

FOREIGN PATENT DOCUMENTS

DE 102006057086 A1 6/2008
JP S595896 A 1/1984
JP S5928096 A 2/1984

OTHER PUBLICATIONS

English machine translation of JP59-5896, Mar. 25, 2021.*
(Continued)

*Primary Examiner* — Christopher Verdier
(74) *Attorney, Agent, or Firm* — Dickinson Wright PLLC

(57) ABSTRACT

A radial fan that includes a fan wheel, which can be rotated about an axis and which comprises a base plate and airfoils protruding from the base plate, wherein the airfoils each comprise an upstream edge in a first spacing (r1) from the axis and a downstream edge in a second spacing (r2) from the axis, and an end wall, which together with the base plate, delimits a flow channel in which the airfoils engage. The cross-sectional area (A) of the flow channel between the upstream edge and the downstream edge passes through a maximum in a third spacing (r3) from the axis. The difference between a fourth spacing (r4) and a fifth spacing (r5), at which the cross-sectional area (A) in each case assumes nearest adjacent minima to the maximum, is at least half of the difference (r2–r1) between the first and the second spacing.

19 Claims, 3 Drawing Sheets

(58) Field of Classification Search
CPC ..... F04D 29/4233; F04D 29/441; F05D 2250/711; F05D 2250/712
See application file for complete search history.

(56) References Cited

OTHER PUBLICATIONS

English machine translation of JP59-28096, Mar. 25, 2021.*
European Patent Office, Rijswijk, Netherlands, International Search Report of International Application No. PCT/EP2018/057944, dated Jun. 21, 2018, 2 pages.

* cited by examiner

RADIAL FAN

CROSS-REFERENCE TO RELATED APPLICATIONS

This application is a 35 U.S.C. § 371 national phase application of International Application No.: PCT/EP2018/057944, filed Mar. 28, 2018, which claims the benefit of priority under 35 U.S.C. § 119 to German Patent Application No.: 10 2017 003 431.1, filed Apr. 7, 2017, the contents of which are incorporated herein by reference in their entirety.

FIELD

The present invention relates to a radial fan with a fan wheel which can be rotated about an axis, and which comprises a base plate and airfoils protruding from the base plate.

BACKGROUND

Various embodiments of such a radial fan are described in DE 10 2006 057 086 A1. In some embodiments, a cover is placed on the edges of the airfoils facing away from the base plate, wherein said cover rotates together with the base plate and the airfoils, and, together with the base plate, it delimits a flow channel through which air is pumped by the rotation of the fan wheel. Such an airfoil is relatively complicated to produce, since it has to be assembled from multiple parts, and it has a rather high moment of inertia. In other embodiments, the edges of the airfoils are directly opposite an end wall which is not connected to the fan wheel and which does not rotate together with it. Such an open fan wheel is easier and more cost effective to produce and it has a lower moment of inertia than the fan wheel with a cover. In order to rule out a contact in such a fan wheel between the edges of the airfoils and the nonrotating end wall lying opposite them, a gap has to be kept free between them, taking into consideration manufacturing tolerances of sufficient width. In the immediate vicinity of the nonrotating end wall, the flow speed of the air is low. The greater the distance between the airfoils and the end wall is, the broader the transition zone between end wall and the airfoils in which only low flow speeds are achieved is, which affects the efficiency of the fan. In the extreme case, under the influence of a counter-pressure, a reversal of the flow direction in the transition zone can even occur, leading to further losses of efficiency.

SUMMARY

The object of the disclosure is to produce a radial fan which is simple and advantageous to produce and nevertheless highly efficient.

The object is achieved in that, in a radial fan with a fan wheel rotating about an axis, which comprises a base plate and airfoils protruding from the base plate, wherein the airfoils in each case comprise an upstream edge in a first spacing from the axis and a downstream edge in a second spacing from the axis, and with an end wall which together with the base plate delimits a flow channel in which the airfoils engage, the cross-sectional area of the flow channel between the upstream and the downstream edge passes through a maximum in a third spacing from the axis, and the difference between a fourth and a fifth spacing, at which the cross-sectional area in each case assumes nearest adjacent minima to the maximum, is at least half of the difference between the first and the second spacing.

If one does not take into consideration the delaying effect of the stationary end wall on the air flow driven by the rotating fan wheel, one would have to assume that an ideal efficiency of the fan wheel in fact would have to be achieved when the free cross section of a path taken by the air flowing through the fan remains the same over the entire length of the path, so that the air can travel the entire path with constant speed without losses due to an accumulation of air. Surprisingly, it has been shown that this is not the case in a radial fan in which the flow channel is delimited by a stationary end wall and that a better efficiency can be achieved when the free cross section of the path as defined above between the upstream and the downstream edges of the airfoils passes through a maximum, and the spacing between minima of the cross-sectional area surrounding this maximum in the flow direction of the air on both sides is large enough so that there is space between the site of the maximum and the edges of the airfoils for a gradual cross section variation, which is free of turbulence-promoting stages.

A reliable hydrodynamic explanation for this observation is not yet available at this time. An attempt at explaining the observation can be made as follows:

In a flow channel with constant cross section, the pressure gradient runs counter to the flow direction. Air which, close to the stationary end wall, is not driven sufficiently by the airfoils, therefore tends to form a short-circuit flow running on the end wall along the pressure gradient to the inlet of the fan. At the site of the cross section maximum, more airfoil surface is in a sense available for driving the air flow than in front of it or behind it in the flow channel. Since it is thus pumped away particularly rapidly from the site of the maximum, the pressure is relatively low there, and the pressure gradient does not extend tangentially to the end wall, but instead is directed at a slant with respect to the end wall into the flow channel. Instead of flowing to the inlet, the air not captured sufficiently by the airfoils is deflected by the pressure gradient from the end wall and within reach of the airfoils, and thus the short-circuit flow is interrupted or suppressed. In particular in small fans, in which, due to unavoidable manufacturing tolerances, the spacing between the end wall and the opposite edges of the airfoils is a relatively large fraction of the axial extent of the flow channel, tremendous improvements of the efficiency can be achieved in this way.

The difference between the fourth spacing and the second spacing should be smaller than the difference between the third spacing and the fourth spacing. In the extreme case, the first-mentioned difference can be zero, i.e., the minimum can coincide with the downstream edges of the airfoils.

The difference between the cross-sectional areas does not have to be large for a clear effect to be observed; it is sufficient if the cross-sectional area at the fourth spacing is 4% smaller than at the third spacing. A difference of 10% or more can lead to an interfering effect on the volume flow.

Just as the cross-sectional area downstream of the maximum should gradually decrease in order to prevent turbulence, it preferably gradually increases in front of the maximum. Therefore, the difference between the third spacing and the fifth spacing, which is smaller than the third spacing, should be at least one fourth of the difference between the first and the second spacing.

The cross-sectional area at the fifth spacing can be smaller than at the fourth spacing, it can differ by more than 8% from the third spacing.

In order to exclude turbulence-promoting abrupt changes in cross section, the radius of curvature of the end wall in the radial section between the first and the second spacing is preferably nowhere smaller than one fourth of the first spacing.

The maximum of the cross-sectional area can be formed due to surface region of the end wall in the third spacing from the axis, which is concave in the radial section.

The minimum radius of curvature of this concave surface region is preferably greater than that of the entire end wall; in particular, it can be selected to be at least equal to the first spacing.

In order to be able to effectively interrupt the short-circuit flow, the airfoils, in the third spacing from the axis, in each case have a protrusion engaging in the concave surface region.

The cross-sectional area can be defined and calculated in different ways; a convenient definition here is the product of a spacing from the axis and the axial distance measured in this spacing between end wall and base plate.

The fan wheel can be produced in a cost-effective manner by one-piece molding, in particular by injection molding.

The end wall can be part of a housing which forms a wheel chamber enclosing the fan wheel. The wheel chamber can moreover comprise a blowing air channel extending around the fan wheel, in which the air conveyed by the fan wheel can accumulate.

An excess pressure in the blowing air channel can be used for cooling a motor, in that a cooling air channel starts from the blowing air channel.

In order to make the air throughput in the cooling air channel as independent as possible of the excess pressure in the blowing air channel, the air used for cooling the motor is advantageously fed back into the wheel chamber.

In order to ensure a sufficient pressure gradient in the cooling air channel, an opening of the cooling air channel into the wheel chamber can be arranged opposite the base plate of the fan wheel.

BRIEF DESCRIPTION OF THE DRAWINGS

Additional features and advantages of the invention result from the following description of embodiment examples in reference to the appended figures, in which:

FIG. 4 shows measurement curves of the pressure increase and of the efficiency of the radial fan according to the invention and of a conventional fan.

DETAILED DESCRIPTION

Figure 1:
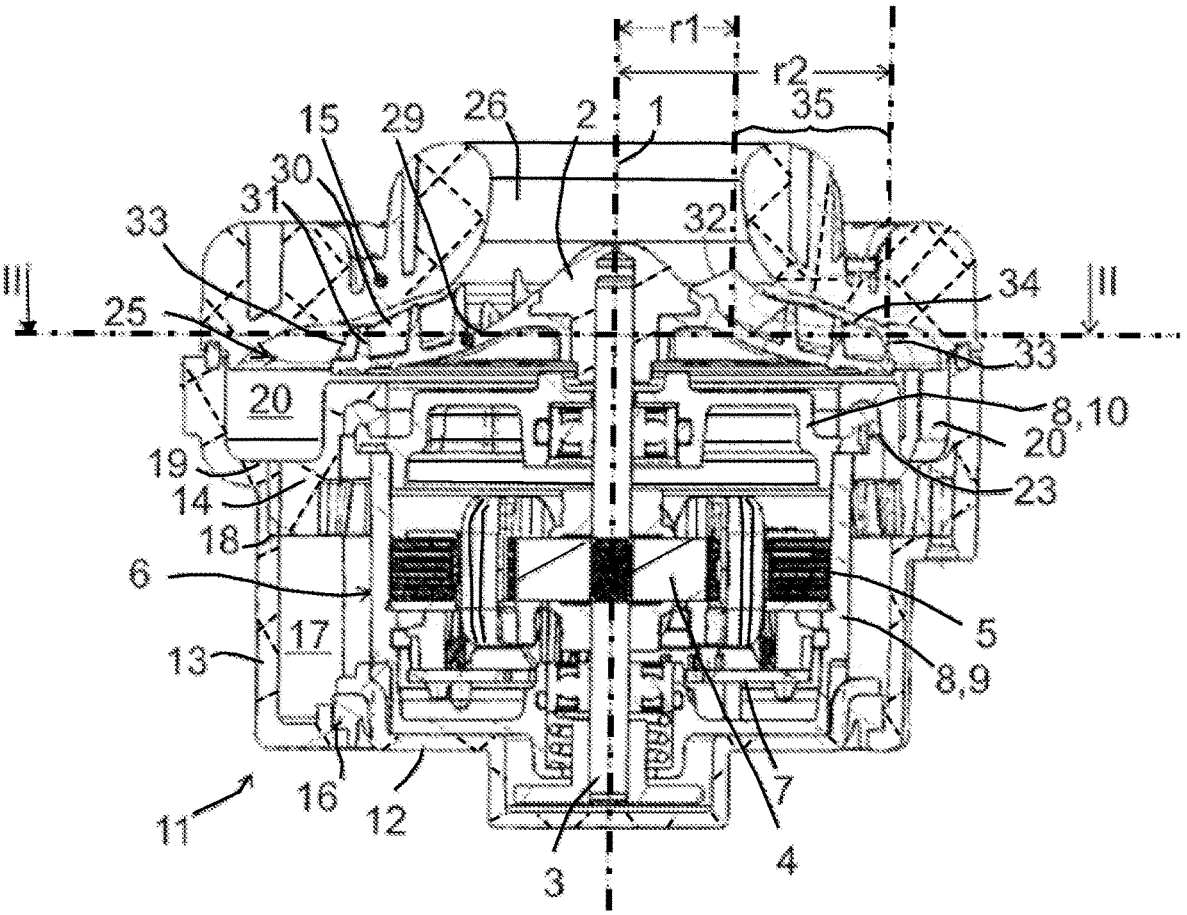
FIG. 1 shows a radial section through a radial fan according to the invention.

Referring to FIG. 1 a radial fan is shown according to the present disclosure in section along a rotation axis 1 of its fan wheel 2. One can see shaft 3, rotor 4 and stator 5 of an electric motor 6 as well as a circuit board 7, which supports an inverter for supplying the motor 6, enclosed in an inner housing 8. The inner housing 8 comprises a container 9 which receives the motor 6 and the circuit board 7, and a cover 10 which closes the container 9 and through the central opening of which the shaft 3 protrudes.

An outer housing 11 comprises a bottom plate 12, an outer wall 13, an annular partition 14, and an end wall 15. The bottom plate 12 is connected by the outer wall 13 via an elastic buffer ring 16 to a second outer container, which receives the inner container 9 forming a cooling air channel 17 extending annularly around the inner container 9 and the motor 6.

The outer wall 13, on its inner side, comprises two shoulders 18, 19, where the diameter thereof decreases in each case toward the bottom plate 12. The partition 14 is inserted into the hollow space surrounded by the outer wall 13 so that an edge of the partition 14 lies on the shoulder 18 close to the bottom. In this position, the outer wall 13 and the partition 14 together form a blowing air channel 20, the bottom of which is formed by the shoulder 19.

Figure 2:
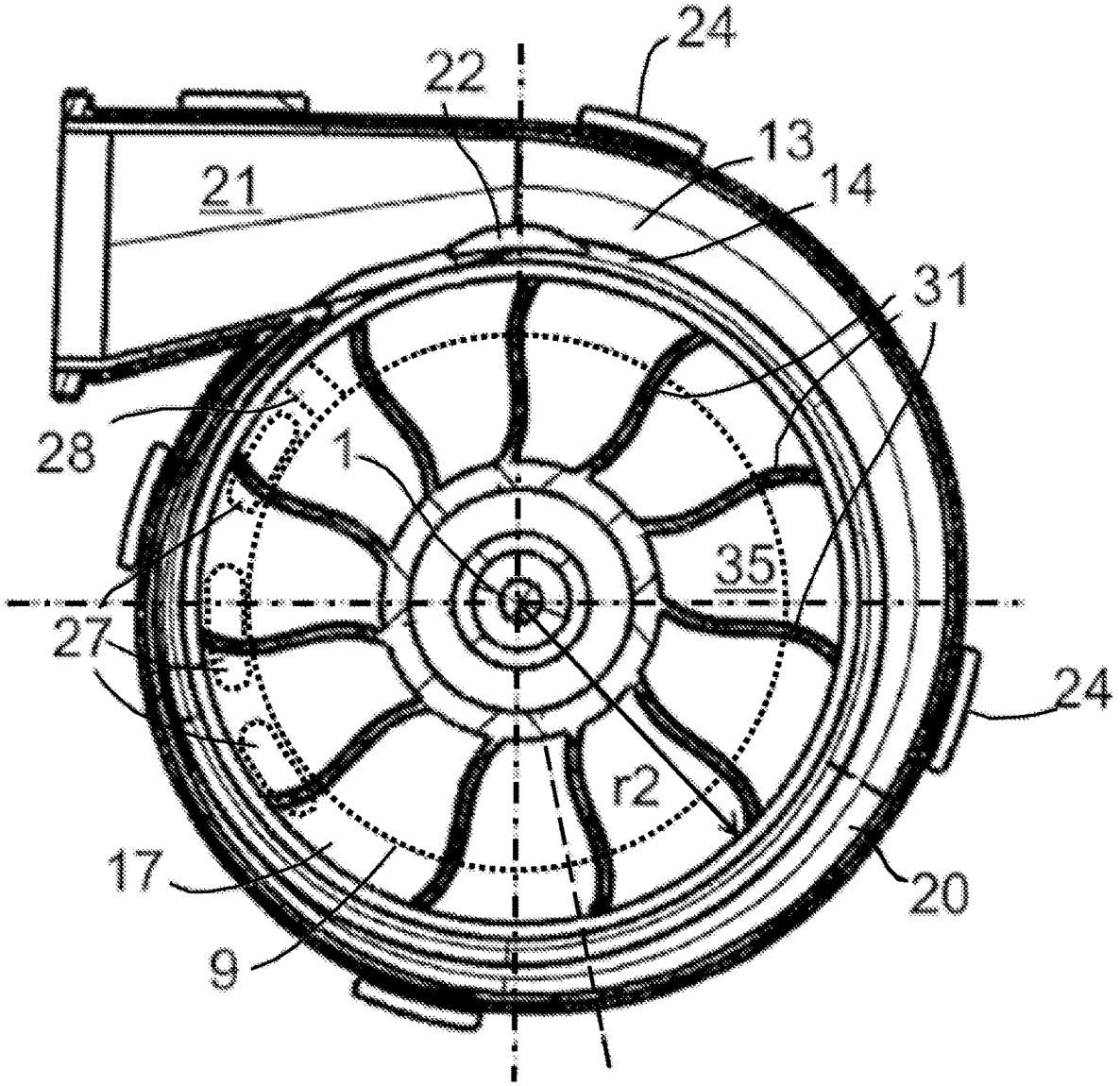
FIG. 2 shows an axial section through a fan chamber of the radial fan of FIG. 1.

As can be seen in FIG. 2, which shows a section through the radial fan along a sectional plane designated by II-II in FIG. 1, the blowing air channel 20 extends with gradually increasing cross section around the shaft 1 and transitions after a rotation about the axis 1 into a tangentially branching off outlet channel 21. At the transition from the blowing air channel 20 to the outlet channel 21, at the bottom of the blowing air channel 20 between the outer wall 13 and the partition 14, a passage 22 is hollowed, which connects the blowing air channel 20 to the cooling air channel 17.

As again shown in FIG. 1, the cover 10 of the inner housing 8 engages in a central opening of the partition 14. Between the cover 10 and the partition 14, an additional elastic buffer ring 23 extends. The inner housing 8 is oscillation-damped by the buffer rings 16, 23 opposite the outer wall 13, so that oscillations of the motor 6 are transmitted only to a slight extent as impact sound to the environment.

On the edge of the outer wall 13 facing away from the bottom plate 12, the end wall 15 is latched to the outer wall 13 with the help of catches 24 (see FIG. 2, 3), which enclose protrusions of the outer wall 13. The end wall 15 together with the outer wall 13, the partition 14 and the cover 10, delimits a wheel chamber 25. The wheel chamber 25 accommodates the fan wheel 2 stuck on an end of the shaft 3. As a result of the rotation thereof, air is suctioned into the wheel chamber 25 via a central inlet opening 26 of the end wall 15 in a manner which is known per se, is driven radially outward into the blowing air channel 20 and is released again to the outside via the outlet channel 21 thereof.

The partition 14 has one or more openings 27 which communicate with the cooling air channel 17 and which are adjacent to the end of the blowing air channel 20 facing away from the outlet channel 21. These openings 27 are hidden in the representation of FIG. 2 by the fan wheel 2 and are therefore represented by a dashed line. The rotation of the fan wheel 2 generates a higher pressure in front of the passage 22 than at the openings 27, so that air enters the cooling air channel 17 via the passage 22, absorbs waste heat of the motor 6 there, and then returns via the openings 27 into the wheel chamber 25. A radial wall 28 between the container 9 and the outer wall 13 sections the cooling air channel 17 and forces the suctioned air to almost completely circumnavigate the container 9 on the way from the passage 22 to the openings 27.

The fan wheel 2 comprises a base plate 29 which together with the end wall 15 delimits a flow channel 30, in which the air is driven radially outward by the rotation of the fan wheel 2, and a plurality of airfoils 31 which protrude from a surface of the base plate 29 facing the end wall 15 into the flow channel 30. The airfoils 31 are in the shape of ribs which extend substantially in radial direction in each case from a radially inner upstream edge 32 to a downstream edge 33 and comprise an elongate vertex edge 34 lying opposite the end wall 15 at a small distance. The upstream edges 32 and the downstream edges 33 of the airfoils 31 lie on circles around the axis 1 with radii r1, r2. The surface of the base plate 29, in an annular region 35 between the two circles, has approximately the shape of a rotation hyperboloid centered on the axis 1.

If, in this region 35, the cross-sectional area of the flow channel 30 run through by the air were constant, then the air could flow radially outward in this flow channel 30 at constant speed. To be exact, one would have to select a surface as cross-sectional area to which the flow direction of the air is perpendicular at all points. Finding such a surface requires complex simulations. By approximation, it could be replaced by a conical surface which intersects the mutually facing surfaces of the base plate 29 and of the end wall 15 at the same angle. Since, in the case considered here, the opening angle of such a cone between r1 and r2 does not substantially change, and since what matters here is not an absolute cross-sectional area but only their ratio with respect to one another, an additional simplification can be made, and the cone can be replaced by a cylindrical surface, i.e., one uses, as measure for the cross-sectional area, the product of the distance between the base plate 29 and the end wall 15, measured in the direction of the axis 1, and a spacing r of the measurement site from the axis 1.

Figure 3:
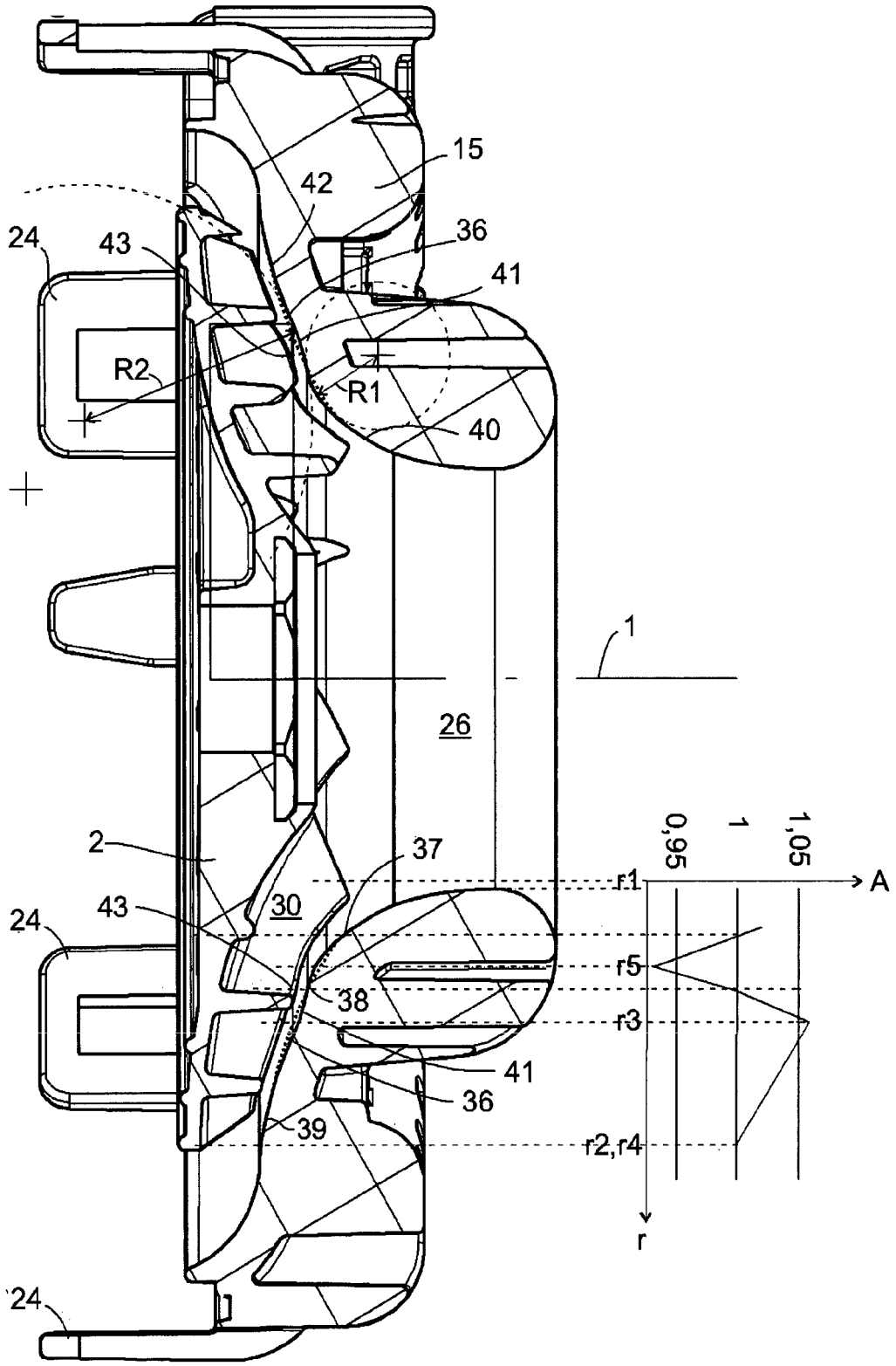
FIG. 3 shows an enlarged radial section through a fan wheel and an end wall of the radial fan from FIG. 1.

A course of the end wall 15, which would meet the requirements of a constant cross-sectional area, is drawn as a dashed contour 36 in the enlarged section of FIG. 3. As one can see, this contour 36 separates tangentially from the actual surface of the end wall 15 at a point 37 in order to extend first up to a point 38 through the material of the end wall 15; from the point 38, it runs through the flow channel 30 until it meets a point 39 again on the surface of the end wall 15. Accordingly, the cross-sectional area of the flow channel 30 is smaller between the points 37 and 38 and greater between the points 38, 39 than at the points 37, 38, 39.

A diagram in the lower right corner of FIG. 3 quantitatively shows the cross-sectional area A of the flow channel 30 as a function of the spacing r from the axis 1, wherein the cross-sectional area at spacing r2 of the downstream edges 33 is arbitrarily set equal to 1. Starting from an initial value close to 1 at small spacings close to r1, the area A first decreases to a minimum at r5, and then reaches a maximum at r3 and from there it again approaches a minimum, a spacing r4 of which here is in agreement with the spacing r2 of the downstream edges 33. The spacing r4–r5 between the two minima here corresponds to approximately two thirds of the spacing r2–r1 between the edges 33, 32. The cross-section decrease from r3 to r4 is considerably more gradual than the increase from r5 to r3, so that, although the difference of the cross-sectional areas between r5 and r3 is greater than between r3 and r4, the spacing r3–r5 is clearly smaller than r4–r3.

At the level of the maximum of the cross-sectional area at r3, the end wall 24, between surface regions 40, 42 which have convex curvature in the radial section, has a concavely curved surface region 41. The radius of curvature of the entire end wall 24 should not be too small, in order to avoid an abrupt deflection of the air and vortex build-up. The smallest value R1 of the radius of curvature is here achieved at spacing r5; R1>0.5 r1 applies. The minimum radius of curvature R2 of the concave region 41 is even larger; for it R2>r1 applies. Opposite the surface region 41, protrusions 43 of the airfoils 31 are located, so that the width of a gap between the vertex edges 34 of the airfoils 31 and the end wall 24 remains substantially constant over the entire length of the vertex edges 34.

FIG. 4 shows measurement curves Δp, Δp' of the pressure increase and η, η' of the efficiency as a function of the volume flow for a radial fan according to the invention, the end wall 15 of which, as shown in FIG. 3, has differently curved surface regions 40, 41, 42, and for a radial fan of equal dimensions with hyperboloid end wall and constant cross section of the flow channel. According to curve η', the conventional radial fan reaches its optimal efficiency of approximately 21% at a volume flow of approximately 270 L/min. At identical volume flow, the efficiency of the fan according to the invention according to curve η is more than 30%, and thus the maximum efficiency is still not reached. At lower volume flows up to and including the efficiency optimum, by means of the fan according to the invention, considerably greater pressure increases can also be achieved, as can be seen in the curves Δp, Δp'.

| List of reference numerals | |
|---|---|
| 1 | Rotation axis |
| 2 | Fan wheel |
| 3 | Shaft |
| 4 | Rotor |
| 5 | Stator |
| 6 | Electric motor |
| 7 | Circuit board |
| 8 | Inner housing |
| 9 | Container |
| 10 | Cover |
| 11 | Outer housing |
| 12 | Bottom plate |
| 13 | Outer wall |
| 14 | Partition |
| 15 | End wall |
| 16 | Buffer ring |
| 17 | Cooling air channel |
| 18 | Shoulder |
| 19 | Shoulder |
| 20 | Blowing air channel |
| 21 | Outlet channel |
| 22 | Passage |
| 23 | Buffer ring |
| 25 | Catch |
| 26 | Wheel chamber |
| 27 | Inlet opening |
| 27 | Opening |
| 28 | Radial wall |
| 29 | Base plate |
| 30 | Flow channel |
| 31 | Airfoil |
| 32 | Upstream edge |
| 33 | Downstream edge |
| 34 | Vertex edge |
| 35 | Region |
| 36 | Contour |
| 37 | Point |
| 38 | Point |
| 39 | Point |
| 40 | Surface region |
| 41 | Surface region |
| 42 | Surface region |
| 43 | Protrusion |

The invention claimed is:

1. A radial fan with a fan wheel which can be rotated about an axis and which comprises a base plate and airfoils protruding from the base plate, wherein the airfoils each comprise an upstream edge in a first spacing (r1) from the axis and a downstream edge in a second spacing (r2) from the axis, and with an end wall which together with the base plate delimits a flow channel in which the airfoils engage, wherein a cross-sectional area (A) of the flow channel between the upstream edge and the downstream edge passes through a maximum in a third spacing (r3) from the axis and in that a difference between a fourth spacing (r4) and a fifth spacing (r5), at which the cross-sectional area (A) in each case assumes nearest adjacent minima to the maximum, is at least half of the difference (r2−r1) between the first and the second spacing;

wherein the fourth spacing (r4) is greater than the second spacing (r2), and a difference (r4−r2) between the fourth spacing and the second spacing is smaller than a difference (r4−r3) between the third spacing and the fourth spacing.

2. The radial fan according to claim 1, wherein the cross-sectional area (A) at the fourth spacing (r4) is at least 4% smaller than at the third spacing (r3).

3. The radial fan according to claim 2, wherein the cross-sectional area (A) is calculated as a product of a spacing (r) from the axis and the axial distance between the end wall and base plate measured in this spacing (r).

4. The radial fan according to claim 1, wherein the fifth spacing (r5) is smaller than the third spacing (r3), and a difference (r3−r5) between the third spacing and the fifth spacing is at least one fourth of a difference between the first and the second spacing (r2−r1).

5. The radial fan according to claim 4, wherein the cross-sectional area (A) at the fifth spacing (r5) is smaller than at the fourth spacing (r4).

6. The radial fan according to claim 5, wherein the cross-sectional area (A) at the fifth spacing (r5) is at least 8% less than the cross-sectional area (A) at the third spacing (r3).

7. The radial fan according to claim 6, wherein the cross-sectional area (A) is calculated as a product of a spacing (r) from the axis and the axial distance between the end wall and base plate measured in this spacing (r).

8. The radial fan according to claim 5, wherein the cross-sectional area (A) is calculated as a product of a spacing (r) from the axis and the axial distance between the end wall and base plate measured in this spacing (r).

9. The radial fan according to claim 4, wherein the cross-sectional area (A) at the fifth spacing (r5) is at least 8% less than the cross-sectional area (A) at the third spacing (r3).

10. The radial fan according to claim 9, wherein the cross-sectional area (A) is calculated as a product of a spacing (r) from the axis and the axial distance between the end wall and base plate measured in this spacing (r).

11. The radial fan according to claim 1, wherein a radius of curvature (R1) of the end wall in a radial section between the first and the second spacing (r1, r2) is no smaller than one fourth of the first spacing (r1).

12. The radial fan according to claim 11, wherein the end wall has a concave surface region in the third spacing (r3) from the axis, which is concave in the radial section.

13. The radial fan according to claim 1, wherein the end wall has a concave surface region in the third spacing (r3) from the axis, which is concave in radial section.

14. The radial fan according to claim 13, wherein the concave surface region in the radial section has a radius of curvature (R2) which is greater than the first spacing (r1).

15. The radial fan according to claim 14, wherein, in the third spacing (r3) from the axis, the airfoils each comprise a protrusion opposite the concave surface region.

16. The radial fan according to claim 15, wherein the cross-sectional area (A) is calculated as a product of a spacing (r) from the axis and the axial distance between the end wall and base plate measured in this spacing (r).

17. The radial fan according to claim 13, wherein in the third spacing (r3) from the axis, the airfoils each comprise a protrusion opposite the concave surface region.

18. The radial fan according to claim 1, wherein the cross-sectional area (A) is calculated as a product of a spacing (r) from the axis and the axial distance between the end wall and base plate measured in this spacing (r).

19. The radial fan according to claim 1, wherein the fifth spacing (r5) is smaller than the third spacing (r3), and a difference (r3−r5) between the third spacing and the fifth spacing is at least one fourth of a difference between the first and the second spacing (r2−r1).

* * * * *